US005722181A

United States Patent [19]

Meyer

[11] Patent Number: 5,722,181

[45] Date of Patent: Mar. 3, 1998

[54] EXHAUST VENT WITH EXTERNAL GUARD

[75] Inventor: Stephen T. Meyer, Indianapolis, Ind.

[73] Assignee: Deflecto Corporation, Indianapolis, Ind.

[21] Appl. No.: 697,444

[22] Filed: Aug. 23, 1996

[51] Int. Cl.[6] ..... F26B 19/00

[52] U.S. Cl. ..... 34/235; 55/337; 55/505; 454/359

[58] Field of Search ..... 34/235; 454/359, 454/353, 367, 368; 55/337, 505

[56] References Cited

U.S. PATENT DOCUMENTS

| | | | |
|---|---|---|---|
| 2,713,398 | 7/1955 | Blum et al. | 55/337 |
| 3,051,230 | 8/1962 | Hart | 55/505 |
| 3,204,546 | 9/1965 | McCabe . | |
| 3,381,601 | 5/1968 | McCabe | 454/359 |
| 3,443,366 | 5/1969 | Schwab | 55/309 |
| 3,456,573 | 7/1969 | Painter | 454/368 |
| 4,022,117 | 5/1977 | Mallian | 454/359 |
| 4,081,915 | 4/1978 | Materniak nee Babcerowicz et al. . | |
| 4,090,436 | 5/1978 | Wright | 454/136 |
| 4,214,380 | 7/1980 | Meyer . | |
| 4,920,867 | 5/1990 | Joly | 98/67 |
| 4,967,490 | 11/1990 | Berger et al. | 34/235 |
| 5,046,408 | 9/1991 | Eugenio | 98/119 |
| 5,383,816 | 1/1995 | Marcello et al. | 454/359 |
| 5,482,507 | 1/1996 | Priest | 361/798 |
| 5,547,422 | 8/1996 | Seboldt | 454/359 |
| 5,568,947 | 10/1996 | Paquette | 285/46 |
| 5,591,080 | 1/1997 | Ward | 454/359 |

FOREIGN PATENT DOCUMENTS

| | | | |
|---|---|---|---|
| 0043504 | 1/1982 | European Pat. Off. | 454/367 |

OTHER PUBLICATIONS

"1994 Hardware Catalog", Deflecto Corporation, P. O. Box 50057, Indianapolis, IN 46250, (primarily pp. 4, 5, and 6).

*Primary Examiner*—Henry A. Bennett
*Assistant Examiner*—Pamela A. O'Connor
*Attorney, Agent, or Firm*—Woodard, Emhardt, Naughton, Moriarty & McNett

[57] ABSTRACT

An exhaust vent guard for protecting the exit area of an air vent conduit includes an upper hood portion and integrally therewith a lower cage portion. The upper hood portion includes a top wall, a pair of sidewalls, and a front wall, which collectively provide a weather barrier to prevent the entry of rain, snow, and other debris into the air vent conduit. The lower cage portion includes a bottom wall, a pair of sidewalls, and a front wall, each of which are constructed and arranged with a plurality of openings for permitting the free flow of air through the lower cage portion while at the same time being small enough to prevent the nesting of birds inside of the exhaust vent guard. In a related embodiment, a similarly configured exhaust vent guard is used in combination with a vent frame and a pair of flow-control louvers which are pivotally mounted into the vent frame. The vent frame includes a central opening which is covered by the louvers when the louvers are in a closed condition, the louvers being arranged to open in response to an exiting air flow and to close back when the air flow is removed. The guard assembles to the vent frame by a snap-fit arrangement.

17 Claims, 7 Drawing Sheets

EXHAUST VENT WITH EXTERNAL GUARD

BACKGROUND OF THE INVENTION

The present invention relates in general to air and exhaust venting devices which are designed to route a particular flow from a first location to a second location. More specifically the present invention relates to a dryer exhaust vent and the design of an external guard for such a vent.

The exhaust air from a clothes dryer is typically routed from the exhaust port of the dryer to a remote location, normally to the outside atmosphere. A variety of conduits, tubes, clamps, and vents have been designed over the years to address the task of conducting dryer exhaust to the outside atmosphere. Frequently an opening is provided in the wall of the structure which receives a tube or conduit. The other most common type of installation is to remove a small pane of glass and exit through a window. The area surrounding the exit tube or conduit is typically covered and sealed in order to prevent air flow between the outside atmosphere and the inside of the structure. At the exit opening, either in the structure wall or through a window, a hood is typically placed over the exiting end of the exhaust conduit in order to prevent rain and snow from entering the exhaust conduit. The hood is also fairly effective in keeping out leaves and other debris.

The following listed patents provide a representative sampling of dryer exhaust vent designs which have been conceived of over the years:

| Pat. No. | PATENTEE | ISSUE DATE |
|---|---|---|
| 4,214,380 | Meyer | Jul. 29, 1980 |
| 4,081,915 | Materniak et al. | Apr. 4, 1978 |
| 3,204,548 | McCabe | Sep. 7, 1965 |

The combination of the exhaust conduit, the hood, and the necessary connectors, clamps, and tubes are or can be collectively referred to as a dryer exhaust vent. The normal configuration is to have a short exhaust tube exit from the rear panel of the dryer. A length of flexible hose is then placed over the exhaust tube and secured in position with a clamp. The flexible hose is then extended to the exit location where another tube extends through the wall (or window) of the structure. The flexible hose is connected to the interior end of the tube and secured to the tube with a clamp. The exterior end of the tube receives a protective hood.

In order to restrict the back flow of cold air into the dryer, the protective hood may include a one-way flapper. It is important that the flapper be light weight enough to open easily so that there is little or no back pressure. It is also important that the dryer exhaust vent be free of any restrictions that could cause overheating and the risk of a fire within the dryer. With existing hood and flapper designs, there is a further problem which can develop with time and continued use. Gradually, if the flapper is not secured in some manner, it begins to open up and not provide a complete seal against the back flow of cold air. If the flapper is secured or retained in some manner, it may then require too much pressure in order to open, thereby causing an increase in backpressure which increases the risk of fire.

One problem which continues to plague dryer exhaust vents is the nesting of birds and small animals in the immediate vicinity of the vent hood. Frequently the nesting blocks the flapper (if one is used) and/or the exit tube or at least partially interferes such that there is an exit flow restriction of some type. The bird and animal nesting occurs because of the protection provided by the hood and the warmth provided by the dryer exhaust. Since this nesting problem can become critical and actually block the exhaust exit, it would be an improvement to dryer exhaust vent designs if there was some way to prevent nesting in and around the exhaust exit vicinity. The present invention solves this problem in a novel and unobvious way which does not interfere with the exhaust exit and is compatible with virtually any style of dryer exhaust vent.

SUMMARY OF THE INVENTION

An exhaust vent guard constructed and arranged to be mounted to a vertical surface for protecting the exit area of an air vent conduit according to one embodiment of the present invention comprises an upper hood portion and integral therewith a lower cage portion. The upper hood portion includes a top wall, a pair of oppositely-disposed sidewalls, and a front wall. The top wall and the pair of oppositely-disposed sidewalls converge in the direction of the front wall and the upper hood portion is designed so as to provide a weather barrier. The lower cage portion includes a bottom wall, a pair of oppositely-disposed sidewalls, and a front wall. Each of the four cage portion walls are constructed and arranged with a plurality of openings for permitting the free flow of air through each of the four cage portion walls. The size of each opening of the plurality of openings is small enough to prevent the nesting of birds inside of the exhaust vent guard.

An exhaust vent for controlling the air flow through an air exit aperture from a structure according to another embodiment of the present invention comprises a vent frame adapted to establish flow communication with the air exit aperture, a plurality of flow-control louvers pivotally mounted into the vent frame, the louvers being constructed and arranged to permit exiting flow out of the air exit aperture and to substantially block any reverse air flow from outside of the exhaust vent from entering the air exit aperture, and a snap-on exhaust vent guard which is received by the vent frame and which includes an upper hood portion constructed and arranged to provide a weather barrier and a lower cage portion constructed and arranged to first permit the free flow of air through the lower cage portion and to secondly prevent the nesting of birds inside of the exhaust vent guard.

One object of the present invention is to provide an improved exhaust vent.

Related objects and advantages of the present invention will be apparent from the following description.

DESCRIPTION OF THE PREFERRED EMBODIMENT

Figure 1:
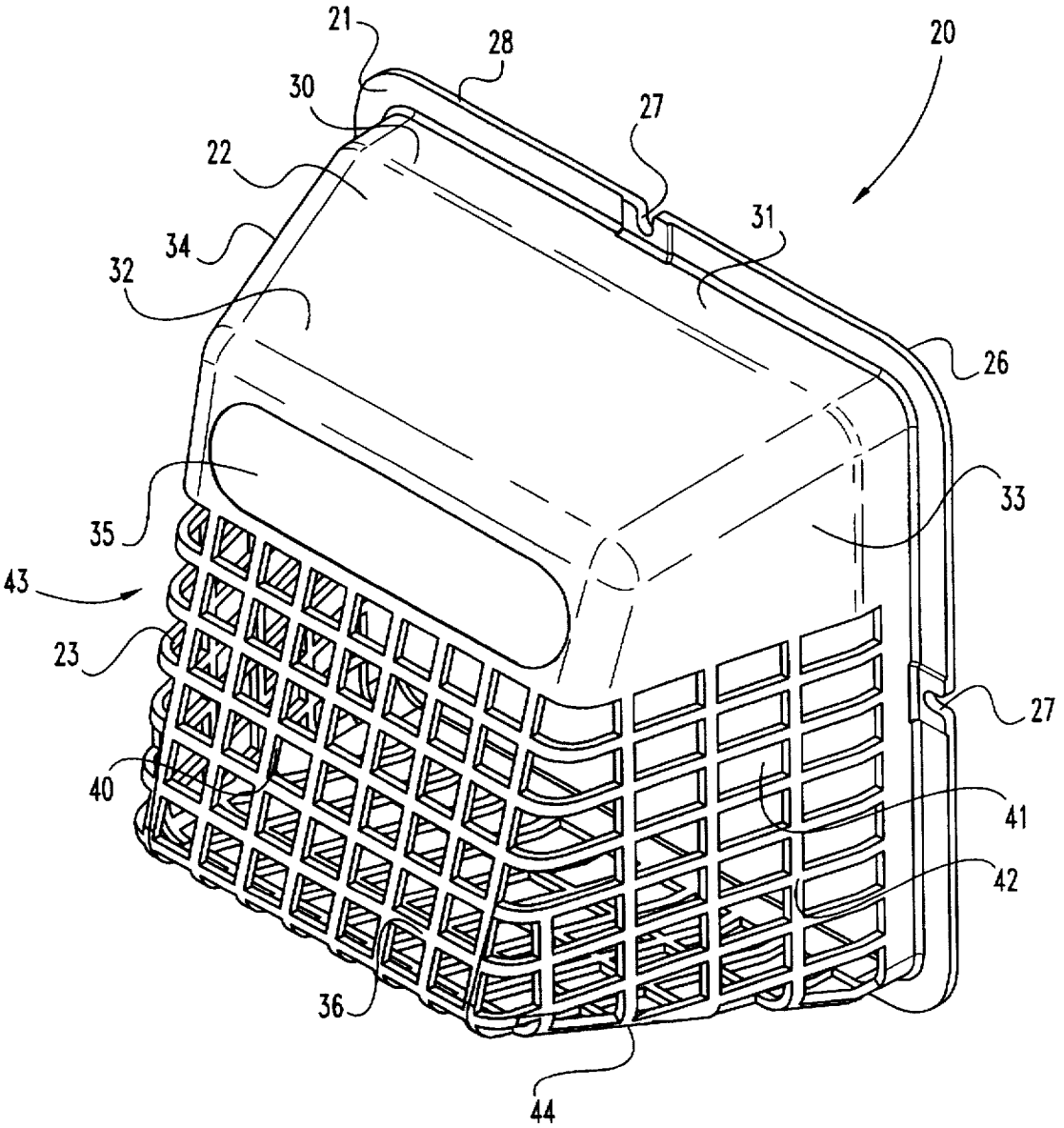
FIG. 1 is a perspective view of an exhaust vent guard according to a typical embodiment of the present invention.
Figure 2:
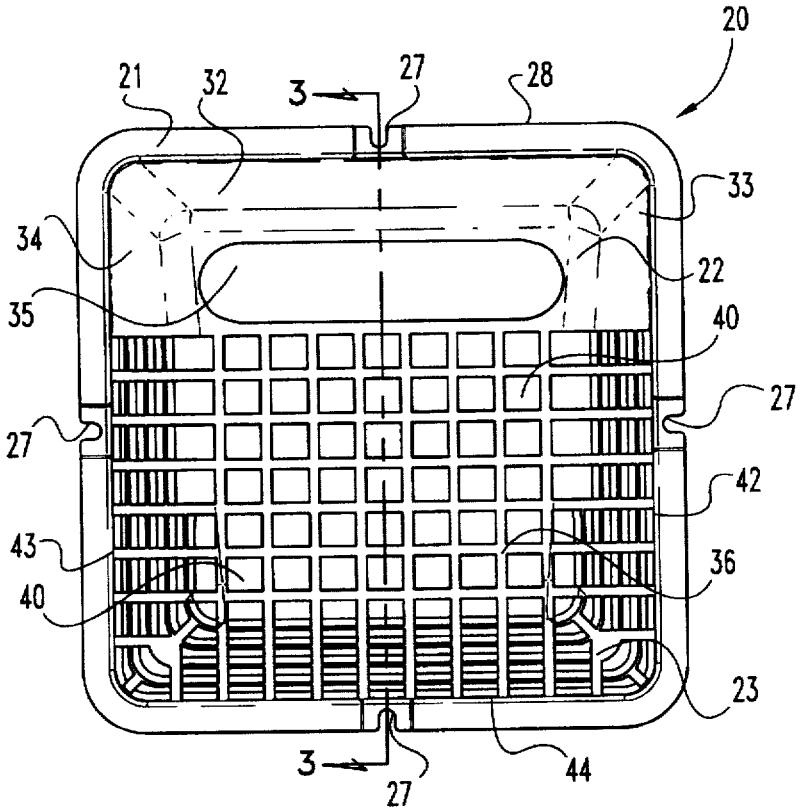
FIG. 2 is a front elevational view of the FIG. 1 exhaust vent guard.
Figure 3:
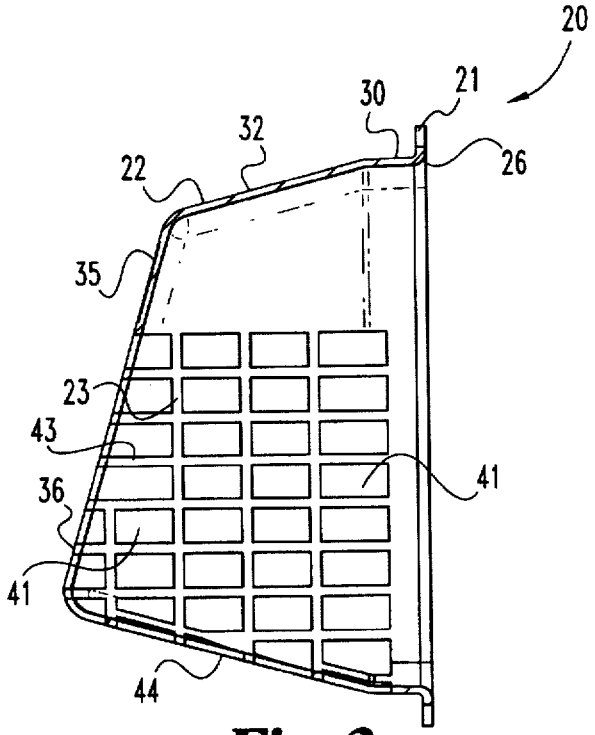
FIG. 3 is a right side elevational view in full section of the FIG. 1 exhaust vent guard as viewed along line 3—3 in FIG. 2.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1–4, there is illustrated a dryer exhaust vent guard 20 which is designed to be positioned over an exhaust vent outlet on the outside of a corresponding structure. Guard 20 is sized so as to fit over the entirety of the exhaust exit location in the structure and attach to whatever surface may be present. The guard 20 is designed to attach by either conventional threaded hardware or by means of a suitable adhesive or caulk. If a vent hood is in use, the guard is sized to fit over the hood. The design illustrated in FIGS. 1–4 is intended to represent a universal size which would be appropriate for dryer exhaust exits regardless of their shape and regardless of whether or not a protective hood is being used. However, except for the flapper feature, a protective hood is not necessary because guard 20 is designed to keep rain, snow, and debris out of the exhaust vent.

Guard 20 is a single-piece (unitary) molded member which can be fabricated from any one of numerous plastics which would provide the requisite strength, durability, and temperature resistance. Guard 20 is designed with three primary portions including a mounting flange 21, hood 22, and cage 23. Flange 21 is substantially flat across rear surface 26, generally square in peripheral shape, and includes four mounting slots 27. Each slot 27 is approximately centered in its corresponding side of flange 21. The mounting slots are provided in the event that conventional threaded fasteners can be used to attach guard 20 to the vertical sidewall surface of the corresponding structure. If this mounting provision is not or cannot be used, the guard can be attached by the use of a suitable adhesive or caulking compound applied to rear surface 26 and around outer edge 28.

Hood 22 includes a transition band 30 whose outer surface 31 is substantially flat and substantially perpendicular to rear surface 26. Band 30 has an approximate 1 degree top and bottom draft angle relative to rear surface 26 and an approximate 2 degree side draft angle. Band 30 extends directly into top wall 32 and sidewalls 33 and 34, and indirectly into front wall 35. As illustrated, the two sidewalls 33 and 34 taper inwardly (converge) as they extend from band 30 to front wall 35. The side edges of top wall 32 converge toward front wall 35 as the front wall extends with a downward incline toward the front wall 36 of cage 23. The downward incline of front wall 35 is at a much steeper angle than the downward incline of top wall 32. Top wall 32 is oriented approximately 15 degrees below horizontal using rear surface 26 as a true vertical frame of reference. Band 30 is oriented approximately 1 degree below horizontal. Front wall 35 is oriented approximately 74 degrees below horizontal. This means that the included angle between front wall 35 as well as front wall 36 relative to rear surface 26 is approximately 16 degrees. The sidewalls 33 and 34 taper inwardly by approximately 15 degrees relative to an imaginary geometric plane which is normal to rear surface 26.

Cage 23 is designed with an open grid including square openings 40 in the front wall 36 and rectangular openings 41 in the sidewalls 42 and 43. The two front "corners" involve a mixture of opening shapes and sizes due to the tapering walls. Since the open grid design can be varied and still keep within the teachings of the present invention, it is necessary to understand that the cage needs to have openings which are large enough to accommodate the free flow of exhaust air without any noticeable restrictions. At the same time, the openings need to be small enough to prevent any birds or small animals from being able to build a nest inside of guard 20. A suitable balance can be found by sizing openings 40 to measure 0.44 inches on a side and by sizing openings 41 to measure 0.41 inches by 0.82 inches. The separating grid material is approximately ⅛ (0.125) inch in width and this is generally the same throughout the cage of guard 20.

Cage sidewalls 42 and 43 have the same general taper as sidewalls 33 and 34, respectively. Bottom wall 44 of cage 23 is oriented in an upward direction as it extends from band 30 to front wall 36. All of the edges and corners are rounded so as to prevent any sharp edges and make the handling of guard 20 easier and without any discomfort to the user. This is important as guard 20 must be handled in order to attach it to the structure.

As is illustrated in FIGS. 1–4, the sidewalls of the hood 22 are substantially coplanar with the sides of cage 23. Similarly, front wall 35 of hood 22 is substantially coplanar with the front wall 36 of cage 23. The solid nature of the various walls of hood 22 provide a suitable barrier against rain and snow and other debris which might fall onto guard 20. The tapered sides of hood 22 provide for the run off of any rain or snow and preclude the creation of any horizontal platform-like surface which might invite a bird to build a nest. The tapered design of hood 22 also helps to funnel and direct any exiting air flow from within the structure through the corresponding exhaust vent down and out through cage 23. Hood 22 provides the requisite weather barrier and cage 23 permits the free flow of air through the guard while still preventing the nesting of birds inside of the guard.

Figure 5:
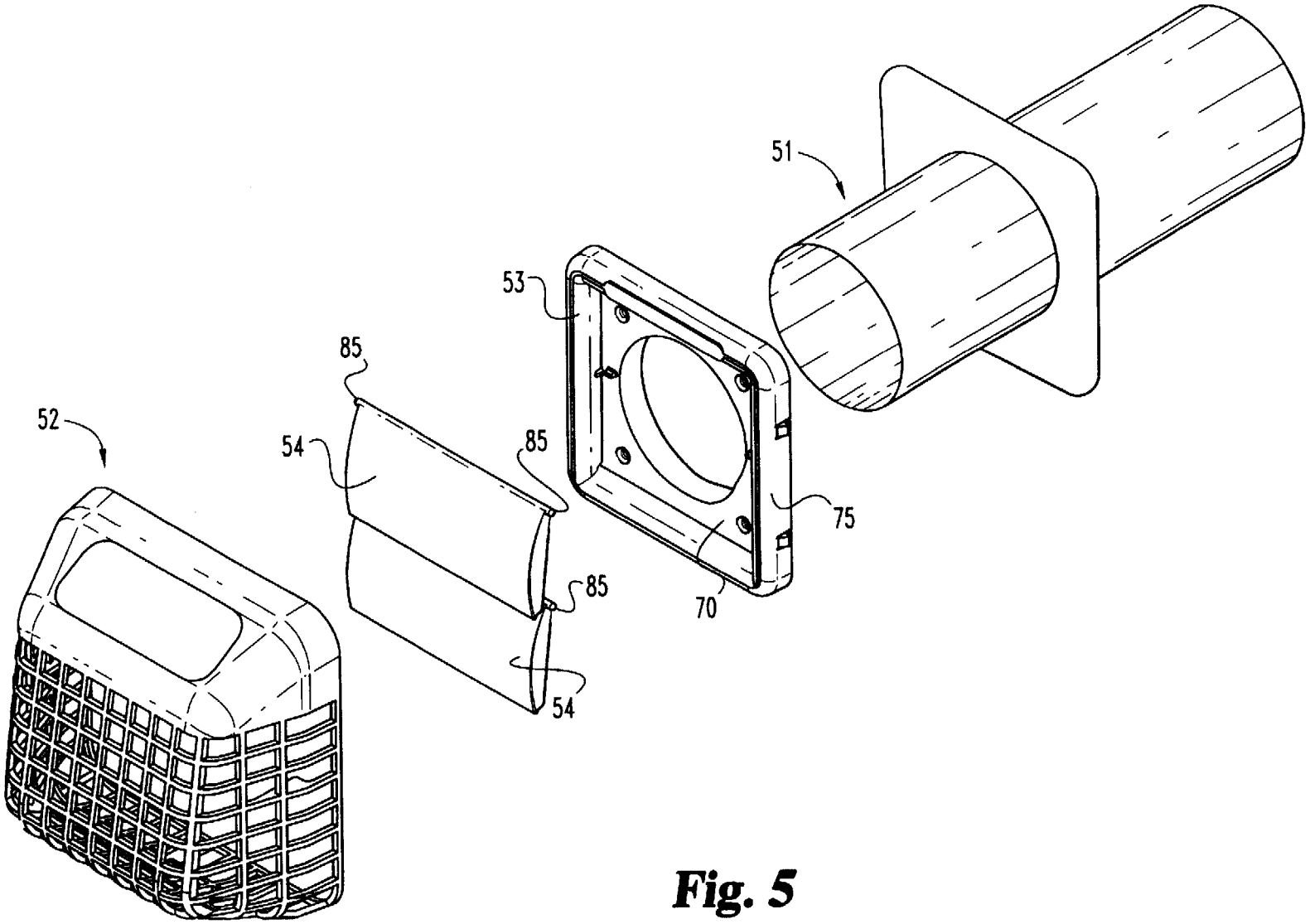
FIG. 5 is an exploded perspective view of an exhaust vent according to a typical embodiment of the present invention.
Figure 4:
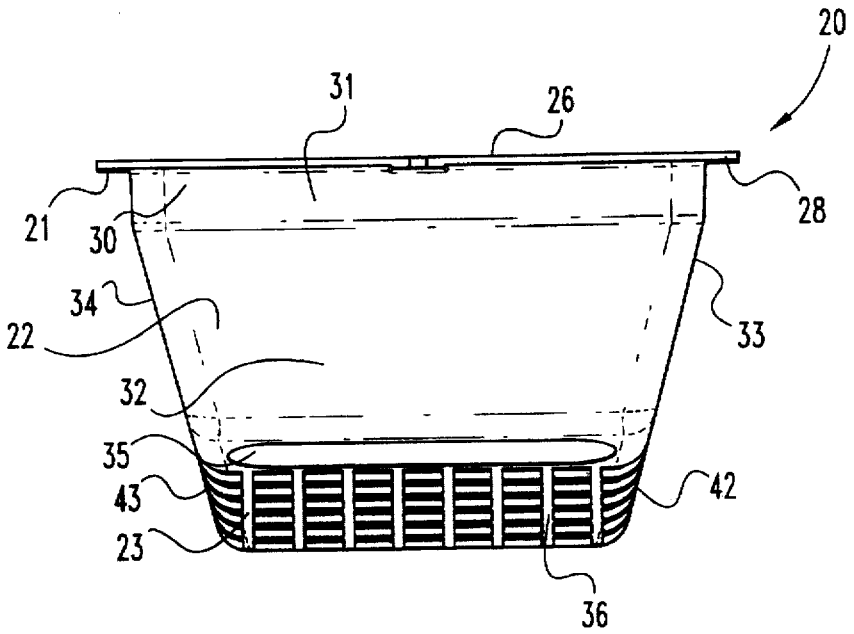
FIG. 4 is a top plan view of the FIG. 1 exhaust vent guard.

Referring now to FIG. 5, there is illustrated as an exploded view a louvered exhaust vent which is designed to fit over an exit conduit tube 51 and which is designed to receive guard 52. The vent includes frame 53 and snap-in louvers 54 and 55. Guard 52 is also designed for a snap-fit onto frame 53 and in this manner, this design eliminates the need for any additional mounting provisions such as an outwardly extending flange. Since guard 52 serves the same purpose as guard 20, the overall designs are similar.

Figure 6:
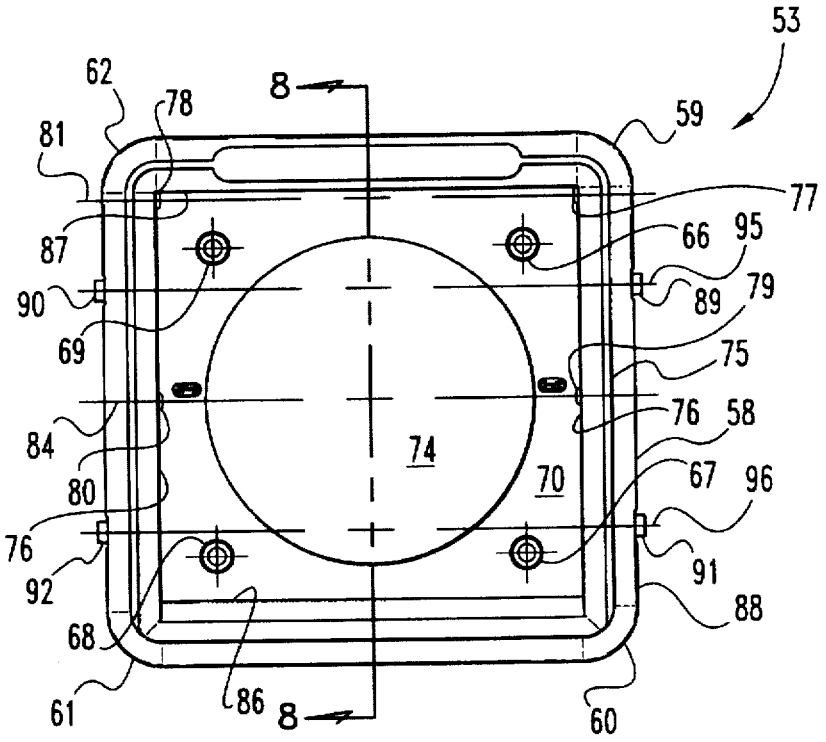
FIG. 6 is a front elevational view of the FIG. 5 exhaust vent frame.
Figure 7:
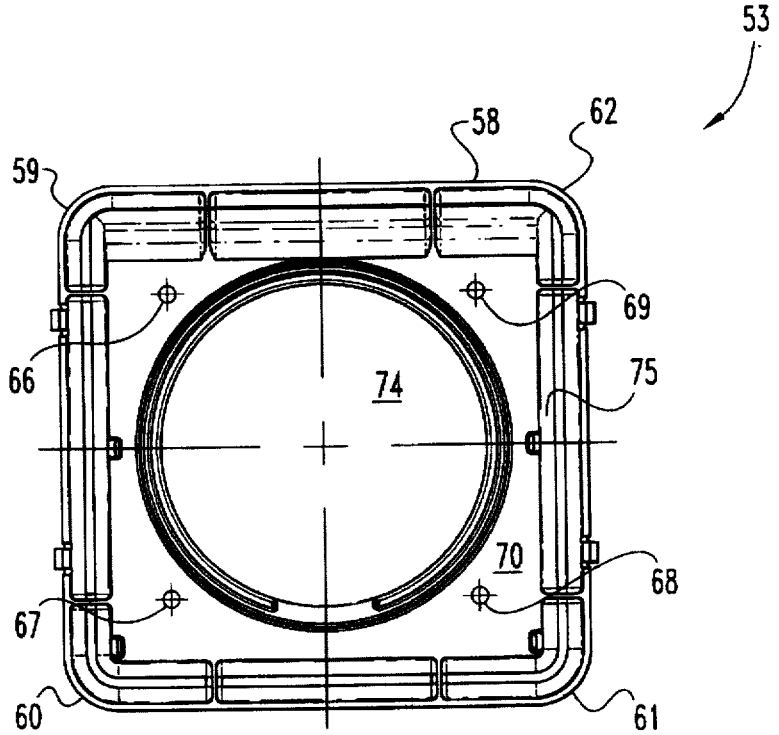
FIG. 7 is a rear elevational view of the FIG. 5 exhaust vent frame.
Figure 8:
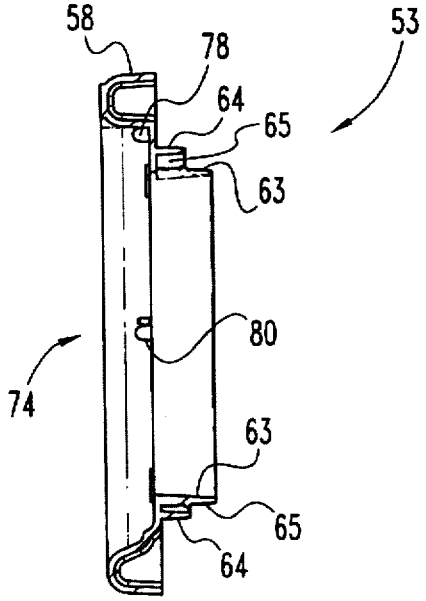
FIG. 8 is a side elevational view in full section of the FIG. 5 exhaust vent frame as viewed along lines 8—8 in FIG. 6.

Referring to FIGS. 6–8, frame 53 is illustrated in greater detail. Frame 53 has a substantially square periphery 58 measuring approximately six inches on a side. The four "corners" 59–62 are each rounded and a relatively short connecting tube 63 extends rearwardly beyond the back edge of the sides of frame 53. A shorter outer wall 64 is spaced apart from tube 63 and defines therewith an annular clearance space 65. This particular arrangement offers a number of connection options for frame 53 relative to tube 51 or relative to some other style of conduit or opening which routes the exhaust air to frame 53.

The connecting or exit conduit tube (such as tube 51) can fit into or around tube 63 or alternatively around outer wall 64. The connection between the exit conduit tube and frame 53 can be secured by tape or a band clamp or possibly by a sealing caulk. Depending on the particular installation, the four mounting holes 66–69 in frame panel 70 can be used to fix the position of frame 53. For example, if the exit conduit tube extends through the wall of a structure but does not extend beyond the structure, then the frame can be pushed up flush against the structure wall. The tube 63 pushes into or around the exit conduit tube and the frame 53 is then securely attached to the structure wall. Opening 74 in frame panel 70 corresponds to the inside diameter of tube 63.

Outer frame wall 75 is raised relative to panel 70 so as to give panel 70 the appearance of being recessed down into the outer frame wall 75. The inside surface 76 of the outer frame wall 75 is configured with two spaced-apart, aligned pairs of pivot holes 77–80. Holes 77 and 78 are disposed adjacent the top inside edge of wall 75 and are aligned with each other so as to be centered on the same horizontal centerline 81. This horizontal centerline denotes the pivoting axis line for louver 54. Holes 79 and 80 are located on horizontal centerline 84 which passes through the center of opening 74. Centerline 84 denotes the pivoting axis line for louver 55.

Louvers 54 and 55 are each designed with a pair of outwardly-extending, short pivot posts 85 which are received within the pivot holes 77–80. In order to snap the louvers into position, each louver needs to be flexed slightly so as to impart a slight concave curvature to the louver between pivot posts 85. This shortens the distance between the oppositely-disposed pivot posts and allows them to clear the inside surface 76 of the outer frame wall 75. When the pivot posts 85 are in alignment with the corresponding pair of pivot holes, the flexing pressure on the louver is released and the louver snaps back to shape as the pivot posts drop into the pivot holes.

The area of panel 70 is effectively covered by the two louvers 54 and 55 which have a slight overlap with each other. The lower edge 86 of frame wall 75 is tapered upwardly and inwardly so as to provide a suitable sealing lip and abutment surface for the lower edge of louver 55. As the lower edge of louver 55 abuts up against this sealing lip, there is an effective blockage created at that location in order to prevent the flow of outside air through frame 53. Other points of entry for the back flow of outside air are also effectively closed or sealed as has been and will be described.

When there is a flow of exhaust air through exit conduit tube 51, the exiting pressure of the flow acts on the backside of the two louvers 54 and 55 causing the louvers to open by pivoting upwardly and outwardly. This opening of the louvers exposes opening 74 to the atmosphere by way of guard 52. When the flow of exhaust air stops, gravity and the freely pivoting action of the two louvers returns the two louvers to their closed condition. By positioning the top edge of louver 54 in close proximity to the upper edge 87 of frame wall 75 and by the presence of panel 70, there is effectively no air flow path into the exit conduit tube. Similarly, the overlap of the two louvers, the length of the two louvers, and the design of lower edge 86 all contribute effectively to accomplishing the task of blocking any potential flow path for incoming air. While all of the air entry points are not hermetically sealed, there is more than adequate blockage to prevent any noticeable back flow of outside air.

Disposed on the outer surface 88 of frame wall 75 are two spaced-apart, aligned pairs of snap-on tabs 89–92. Tabs 89 and 90 are positioned on the same horizontal centerline 95 which is substantially parallel to and located between horizontal centerlines 81 and 84. Tabs 91 and 92 are positioned on the same horizontal centerline 96 which is substantially parallel to horizontal centerline 95 and disposed below horizontal centerline 84 near lower edge 86. Each snap-on tab has a wedge-like shape which is inclined outwardly as the tab extends rearwardly toward tube 51 and away from guard 52. Each tab 89–92 includes a small relief area between the tab and the outer frame wall 75 so that each tab can flex inwardly as the guard 52 is pushed into position onto frame 53. Once the guard is advanced to a sufficient depth onto frame 53, each of the four tabs 89–92 snap back and extend into a corresponding one of the rectangular openings in the sidewalls of guard 52. The grid wall portions which define the rectangular openings provide an abutment edge against the raised rear edge of each tab 89–92 in order to prevent pull off of guard 52 from frame 53. If the four tabs are manually pushed inwardly, it is possible to free guard 52 and remove it from frame 53 without damage to either part.

Figure 9:
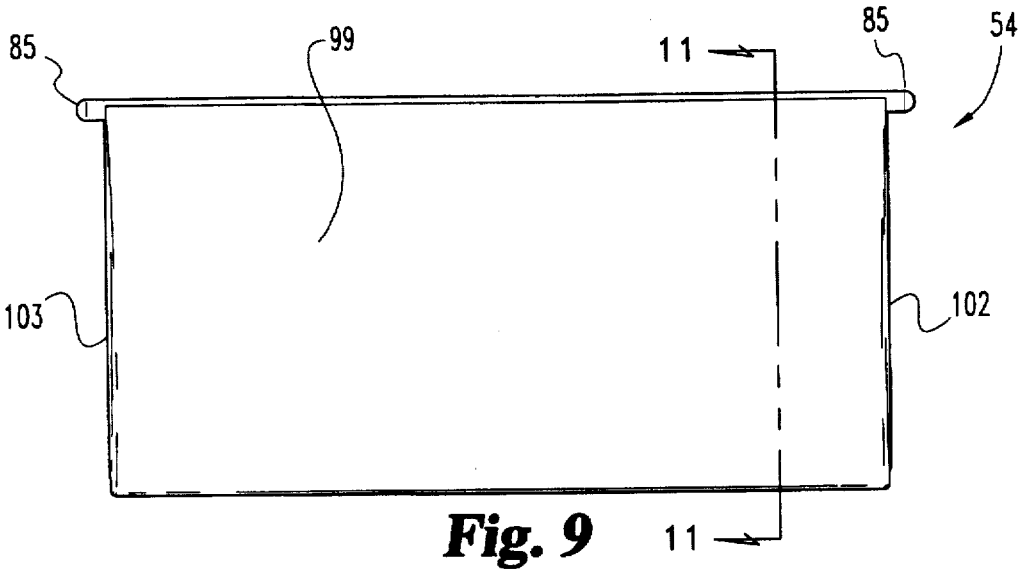
FIG. 9 is a front elevational view of one of the FIG. 5 louvers according to the present invention.
Figure 10:
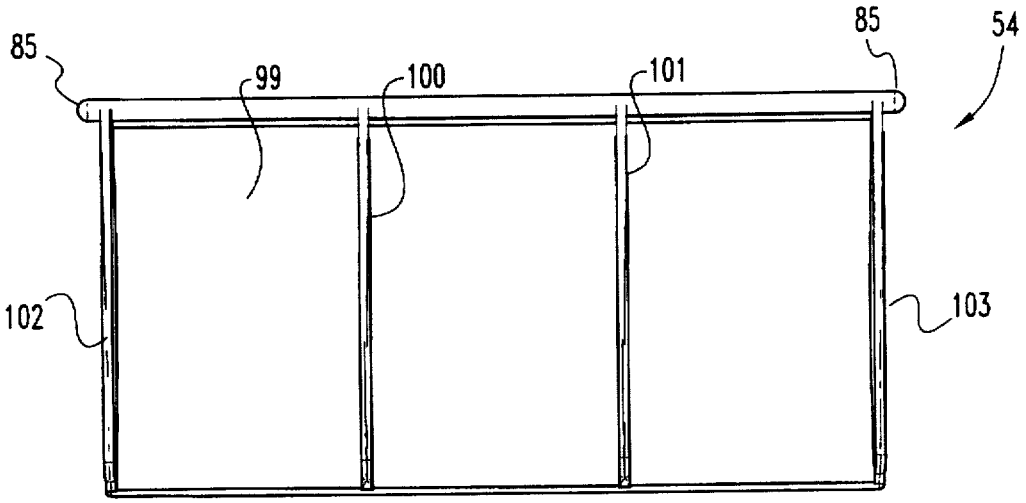
FIG. 10 is a rear elevational view of the FIG. 9 louver.
Figure 11:
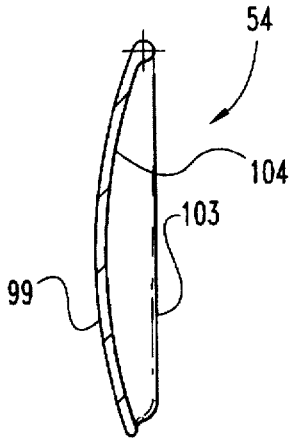
FIG. 11 is side elevational view in full section of the FIG. 9 louver as viewed along line 11—11 in FIG. 9.

Referring to FIGS. 9–11, the design of louver 54 is illustrated. Louver 55 has a design which is virtually identical in all respects to louver 54. Louver 54 is a unitary, molded plastic member which includes a curved main body 99, two oppositely-disposed pivot posts 85, two stiffening ribs 100 and 101, and two oppositely-disposed side panels 102 and 103. The concave inside surface 104 of the main body 99 is important in the design of louver 54. When air flow is exiting from tube 51 and flowing through opening 74, it will more readily catch the concave surface 104 and push open the two louvers than if the inside surface was flat. A flat inside surface could cause some of the air to deflect and less of the flow would focus on pivoting movement of the louvers. The curved design of the louvers also helps to maintain their overlapping and sealed condition relative to one another and relative to frame 53. The side panels 102 and 103 help to seal the edge interface between the louvers and frame wall 75 which helps to prevent leakage of outside air into opening 74.

Figure 12:
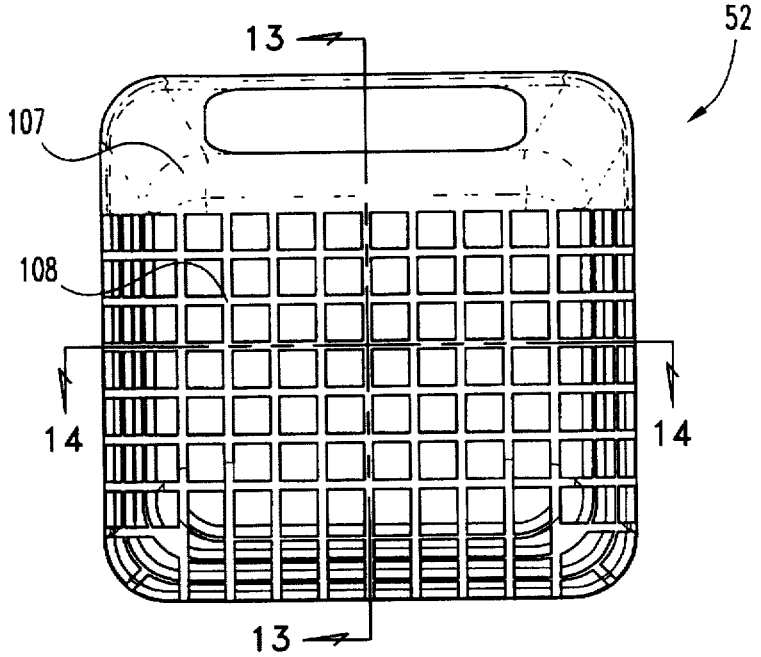
FIG. 12 is a front elevational view of the FIG. 5 guard according to the present invention.
Figure 13:
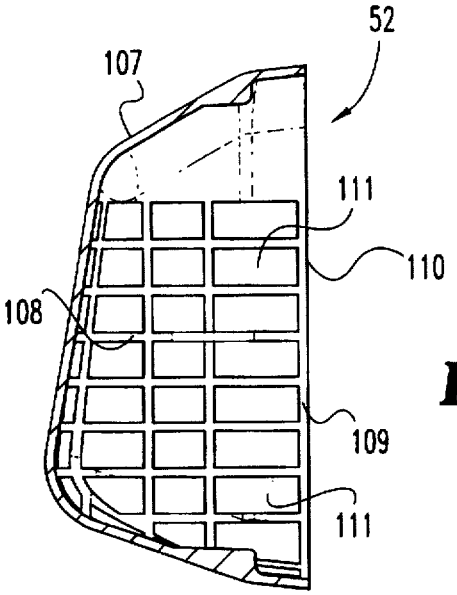
FIG. 13 is a side elevational view in full section of the FIG. 12 guard as viewed along line 13—13 in FIG. 12.
Figure 14:
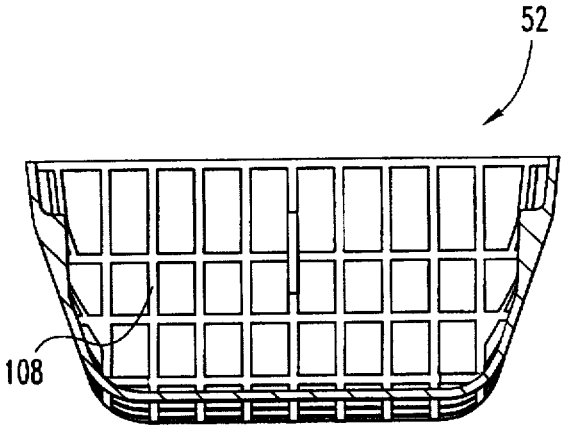
FIG. 14 is a top plan view in full section of the FIG. 12 guard as viewed along line 14—14 in FIG. 12.

Referring to FIGS. 12–14, snap-on guard 52 is illustrated in greater detail. In many respects, guard 52 is designed in a manner which is similar to guard 20. The general design concept of guard 52 involving the solid hood 107, cage 108, and the tapered sides is virtually identical to guard 20. The differences between the two guards relate to their intended use. Guard 20 may be used over any existing vent hood and thus guard 20 is somewhat larger than guard 52 and the shape of guard 20 is more squared off and deeper. Guard 52 which is designed for a snap-fit onto frame 53 can assume a more tapered appearance and has less depth because its interior space only has to accommodate and provide clearance for the two louvers 54 and 55. In order to provide a free exit flow which is virtually unrestricted, it is important that the opening of louvers 54 and 55 not be restricted in any manner. Consequently, guard 52 simply needs to be shaped and large enough so that the fully opened and outwardly extending louvers 54 and 55 will not contact any portion of guard 52.

Guard 20 is designed to be attached or mounted into position by the use of flange 21. Guard 52 is snapped into position and thus there is no outwardly extending flange required and no need for any other mounting provisions other than the portions of guard 52 which are used for the snap fit onto frame 53. As has been described, guard 52 includes a grid wall portion 109 (on each side) along the back edge 110 and four cooperating rectangular openings 111 (two on each side). As described, when the guard 52 is pushed onto frame 53, the sides of cage 108 slide closely along the sides of frame 53 around the entire periphery of the frame until the four snap-on tabs 89–92 are encountered by grid wall portion 109. Continued advancement of guard 52 onto frame 53 pushes inwardly on the tabs until the grid wall portion 109 reaches the end of tabs at which point the four tabs snap into the four cooperating rectangular openings 111 and securely hold the guard 52 onto the frame 53.

Each of the components which have been described are constructed as a unitary, single-piece, molded plastic member, including frame 53. The entire assembly including the snap-in pair of louvers 54 and 55 as well as the assembly of guard 52 is achieved manually without requiring any supplemental mounting hardware, adhesive, or similar items. The only additional item or component which might be required would be used for the mounting of the exit conduit tube 51 relative to the tube 63 or outer wall 64 of frame 53.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An exhaust vent guard constructed and arranged to be mounted in a vertical orientation for protecting the exit area of an air vent conduit comprises:

an upper hood portion including a top wall, a pair of oppositely-disposed sidewalls, and a front wall, said top wall and the pair of side walls converging in the direction of said front wall, each of said hood portion walls being of a solid nature in order to provide a suitable barrier to moisture and debris; and a lower cage portion including a bottom wall, a pair of oppositely-disposed sidewalls, and a front wall, each of said four cage portion walls being constructed and arranged with a plurality of openings for permitting the free flow of air through each of said four cage portion walls, the size of each opening of said plurality of openings being small enough to prevent the nesting of birds inside of said exhaust vent guard.

2. The exhaust vent guard of claim 1 wherein the bottom wall and the pair of oppositely-disposed sidewalls of said lower cage portion converge in the direction of said front wall.

3. The exhaust vent guard of claim 2 wherein the front wall of said upper hood portion and the front wall of said lower cage portion are substantially coplanar.

4. The exhaust vent guard of claim 3 wherein the front wall of each portion is inclined outwardly as it extends downwardly.

5. The exhaust vent guard of claim 1 wherein the front wall of the upper hood portion and the front wall of the lower cage portion are substantially coplanar.

6. The exhaust vent guard of claim 1 which further includes a mounting flange which is adjacent the sidewalls of the upper hood portion, adjacent the sidewalls of the lower cage portion, adjacent the top wall of the upper hood portion, and adjacent the bottom wall of the lower cage portion.

7. The exhaust vent guard of claim 6 wherein one sidewall of the pair of oppositely-disposed sidewalls of said upper hood portion is coplanar with one sidewall of said lower cage portion and the opposite sidewall of the pair of sidewalls of said upper hood portion is coplanar with the other sidewall of said lower cage portion.

8. The exhaust vent guard of claim 7 wherein the majority of the openings in each sidewall of said lower cage portion are substantially rectangular in shape.

9. The exhaust vent guard of claim 8 wherein the majority of the openings in the front wall of said lower cage portion are substantially square in shape.

10. An exhaust vent for controlling the air flow through an air exit aperture from a structure, said exhaust vent comprising:

a vent frame adapted to establish flow communication with said air exit aperture;

a plurality of flow-control louvers pivotally mounted into said vent frame, said louvers being constructed and arranged to permit exiting flow out of said air exit aperture and to substantially block any reverse air flow from outside of said exhaust vent from entering said air exit aperture; and a snap-on exhaust vent guard which is received by said vent frame, said exhaust vent guard including an upper hood portion constructed and arranged to provide a weather barrier and a lower cage portion constructed and arranged to permit the free flow of air through said lower cage portion and to prevent the nesting of birds inside of said exhaust vent guard.

11. The exhaust vent of claim 10 wherein said upper hood portion includes a top wall, a pair of oppositely-disposed sidewalls, and a front wall, said top wall and the pair of sidewalls converging in the direction of said front wall.

12. The exhaust vent of claim 11 wherein said lower cage portion includes a bottom wall, a pair of oppositely-disposed sidewalls, and a front wall.

13. The exhaust vent of claim 12 wherein the four lower cage portion walls are constructed and arranged with a plurality of openings for permitting the free flow of air through each of said four cage portions walls, the size of each opening of said plurality of openings being small enough to prevent the nesting of birds inside of said exhaust vent guard.

14. The exhaust vent of claim 10 wherein said vent frame includes a peripheral wall and a plurality of snap-receipt tabs disposed in said peripheral wall.

15. The exhaust vent of claim 14 wherein said lower cage portion includes a back edge and a plurality of snap-receipt openings, said back edge and said plurality of snap-receipt openings being separated by a grid wall portion, said grid wall portion providing an abutment surface against said snap-receipt tabs with one each of said tabs being positioned in a corresponding one of said snap-receipt openings.

16. The exhaust vent of claim 15 wherein said upper hood portion includes a top wall, a pair of oppositely-disposed sidewalls, and a front wall, said top wall and the pair of sidewalls converging in the direction of said front wall.

17. The exhaust vent of claim 16 wherein said lower cage portion includes a bottom wall, a pair of oppositely-disposed sidewalls, and a front wall.

* * * * *